United States Patent [19]

Beck et al.

[11] 4,416,470

[45] Nov. 22, 1983

[54] DEVICE FOR OBTAINING ACCURATE REGISTRATION OF HANDWRITTEN IMPRESSIONS ON CONTINUOUS BUSINESS FORM SETS

[75] Inventors: Siegfried Beck, Renningen; Philipp Drescher, Stuttgart, both of Fed. Rep. of Germany

[73] Assignee: Drescher GmbH & Co. KG, Rutesheim, Fed. Rep. of Germany

[21] Appl. No.: 332,322

[22] Filed: Dec. 18, 1981

[30] Foreign Application Priority Data

Dec. 30, 1980 [DE] Fed. Rep. of Germany ..... 3049464

[51] Int. Cl.[3] ..... B41L 5/02; B42D 3/18; B42D 19/00

[52] U.S. Cl. ..... 281/7; 281/14; 281/31

[58] Field of Search ..... 281/31, 22, 23, 5, 6, 281/7, 8, 10, 12, 38, 15 R, 3 R, 1, 45, 30, 36, 37; 150/35, 52 B; 190/42; 282/1 A, 2, 8 R, 8 B, 22 R, 22 A, 23

[56] References Cited

U.S. PATENT DOCUMENTS

| | | | |
|---|---|---|---|
| 755,625 | 3/1904 | Curtin | 281/6 |
| 2,161,362 | 6/1939 | Lindsay | 281/1 |

FOREIGN PATENT DOCUMENTS

| | | | |
|---|---|---|---|
| 2749854 | 5/1979 | Fed. Rep. of Germany | 281/31 |
| 2807302 | 8/1979 | Fed. Rep. of Germany | 281/15 R |

*Primary Examiner*—E. R. Kazenske
*Assistant Examiner*—John S. Brown
*Attorney, Agent, or Firm*—Walter Ottesen

[57] ABSTRACT

The invention is directed to a device for obtaining accurate registration of handwritten impressions on continuous business form sets which are detachable into individual form sets by means of longitudinally spaced transverse perforations. The device includes a pocket for receiving the continuous business form sets folded in a zig-zag manner and has a registration plate defining a writing surface for the individual business form set upon which a handwritten entry is made. The outer edge of the registration plate coacts with the transverse perforation to ensure accurate registration of the original sheet and copy sheets of an individual business form set upon which a handwritten entry is made.

12 Claims, 5 Drawing Figures

DEVICE FOR OBTAINING ACCURATE REGISTRATION OF HANDWRITTEN IMPRESSIONS ON CONTINUOUS BUSINESS FORM SETS

FIELD OF THE INVENTION

The invention relates to devices for obtaining accurate registration of handwritten impressions on business form sets which are detachable into individual form sets by means of transverse perforations.

BACKGROUND OF THE INVENTION

Devices for obtaining such accurate registration are known as autographic registers for continuous business form sets upon which autographic impressions are placed and one such autographic register is described in U.S. Pat. No. 2,366,745. Known devices of this kind include box-like, rigid housings made of metal, plastic or the like wherein a supply of continuous business form sets is placed upon which information is to be later recorded autographically. The supply of continuous form sets is placed in the housing as a zig-zag folded stackk. The business form set upon which is desired to make an autographic record is drawn over a plate fixed in the housing. This plate acts as a writing surface and is arranged beneath a window in an opening in the housing cover.

After an autographic record is entered on the individual form set, the form set can be moved away from the recording location on the writing plate by means of a lever arrangement and into a zig-zag folded stack in a storage compartment of the housing.

The individual business form sets generally include an original record sheet and one or more copies lying beneath the original sheet whereby absolute registration accuracy of the original sheet and the copies is required when making the handwritten records and coies thereof. For known devices, the registration accuracy when making the handwritten record and when moving form sets is assured by using means such as pin wheels which engage margin guide holes or registration holes lying transverse to the direction of movement. This requires not only an additional manufacturing effort, but also requires a paper surface space on the form sets which cannot be used for printing nor for making a business record entry.

In addition, the box-like housing renders the known devices difficult to handle and inconvenient to work with when loading and removing the continuous form sets. Also, the necessary mechanical transport mechanisms are subject to failure.

This is especially the case when continuous form sets are used which have undergone changes as a consequence of long or improper storage owing to the hygroscopic characteristics and dimensional stability of the paper. These disadvantages and the relatively large weight of the known devices prevented their broad use by traveling sales personnel because such devices could be taken along on business trips only with great difficulty or not at all.

The generally known continuous business form sets widely used for machine-made records are available as a zig-zag folded stack and are stored again in a zig-zag folded stack after the machine record has been made. Because of the above disadvantages, these form sets were not used to any significant extent where the same had to be used for recording information entirely or only partially by hand as, for example, in commercial sales by traveling salesman.

Accordingly, in many areas, the continuous business form sets are written of necessity with machine writing devices although a handwritten record would be more expeditious.

SUMMARY OF THE INVENTION

It is an object of the invention to provide a device for obtaining accurate registration of handwritten impressions on continuous business form sets which obviates the disadvantages delineated above. It is another object of the invention to provide such a device which takes up little space and material and yet permits handwritten records to be made quickly and conveniently and with accurate registration on continuous form sets not provided with special guide and/or registration means.

A preferred embodiment of the device of the invention includes a pocket for receiving the continuous business form sets which are in a zig-zag folded stack. The pocket at least partially surrounds the stack and has an opening facing in the direction in which the continuous form sets are pulled therefrom. The device also includes a registration plate which is movable with respect to the pocket and defines the writing surface whereon an individual form set of the continuous form sets is placed when making handwritten records thereon.

Other objects, features and advantages of the invention will become more fully apparent from the following detailed descrition of the preferred embodiments the appended claims and the accompanying drawings.

DESCRIPTION OF THE PREFERRED EMBODIMENTS OF THE INVENTION

Figure 1:
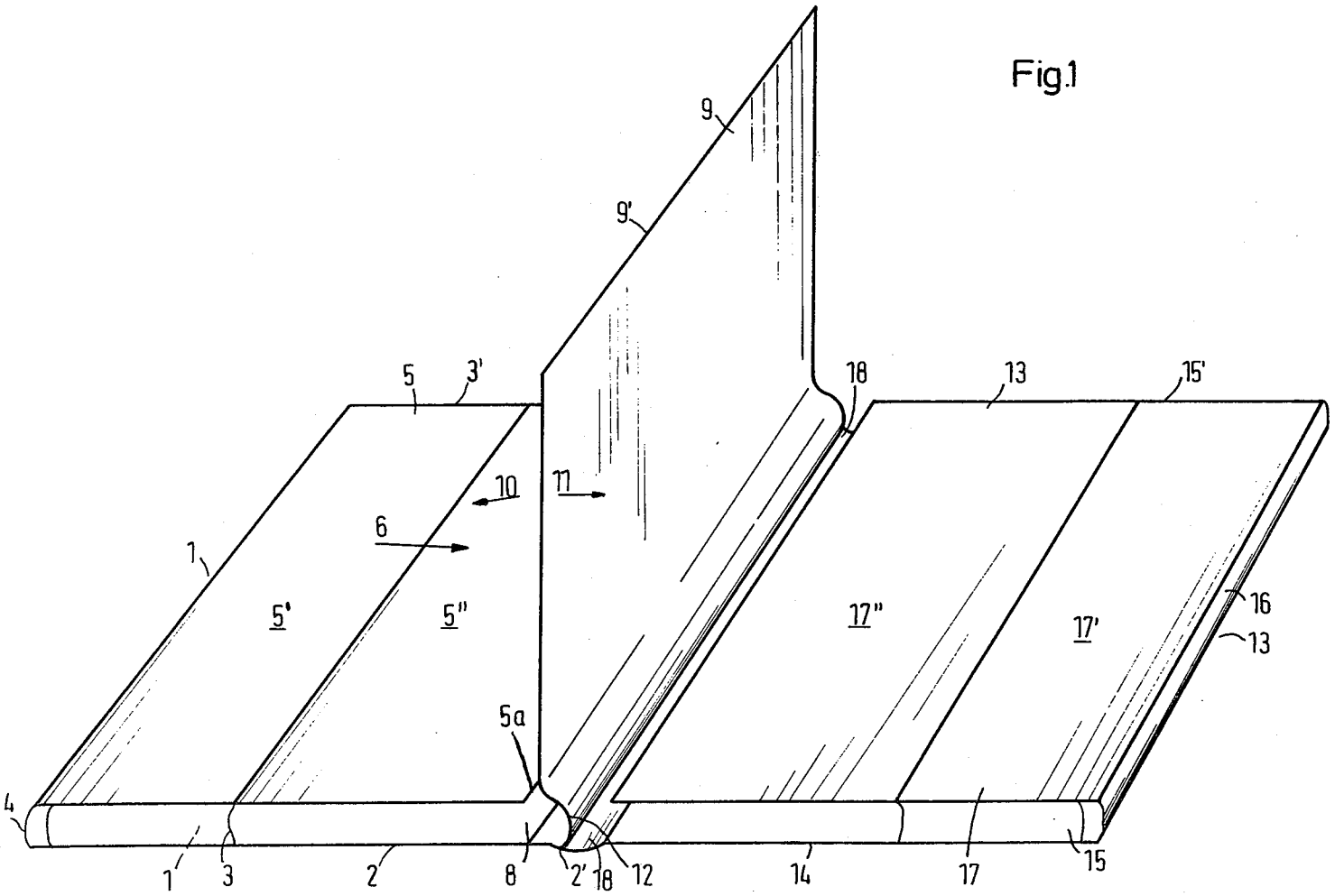
FIG. 1 is a perspective view of a preferred embodiment of the device of the invention including a receiving pocket and a storage pocket wherein the form sets of the continuous business form sets are stored after the handwritten record is entered thereon. The registration plate of the device is shown in the turned-up position.

In its simplest configuration, the device according to the invention includes receiving means in the form of a receiving pocket 1. The pocket 1 is made up of a base plate 2 defining the bottom surface thereof, sidewall 3, side wall 3', back wall 4 and a cover plate 5. The receiving pocket 1 has the format of the continuous form sets which are placed therein and upon which records are to be written. The continuous form sets are in a zig-zag folded stack when placed in the pocket 1. Accordingly, the base plate 2 and the cover plate 5 have larger dimensions than the basic format of the continuous form sets which are to be placed in the pocket. The side walls 3 and 3' are preferably flexible or otherwise configured so that they can be expanded in elevation. In this way, a zig-zag folded stack 7 (FIG. 2) of the continuous form sets of a desired height can be conveniently inserted into the pocket 1.

To permit easy placement of the zig-zag folded stack 7 into the pocket 1, it is advantageous to configure the cover plate 5 of front and rear portions 5'' and 5'. The rear portion 5' is connected with the back wall 4 and the side walls 3 and 3'; whereas, the front portion 5'' is pivotally connected to the rear portion 5' attached to the side and back walls as described above. The front portion 5'' is arranged with respect to rear portion 5' so that it is located in the direction 6 in which the continuous business form sets are pulled from the pocket 1. Because of its location and pivoted connection to the rear portion 5', the front portion 5'' can be turned up to facilitate insertion of the zig-zag folded stack 7.

Figure 2:
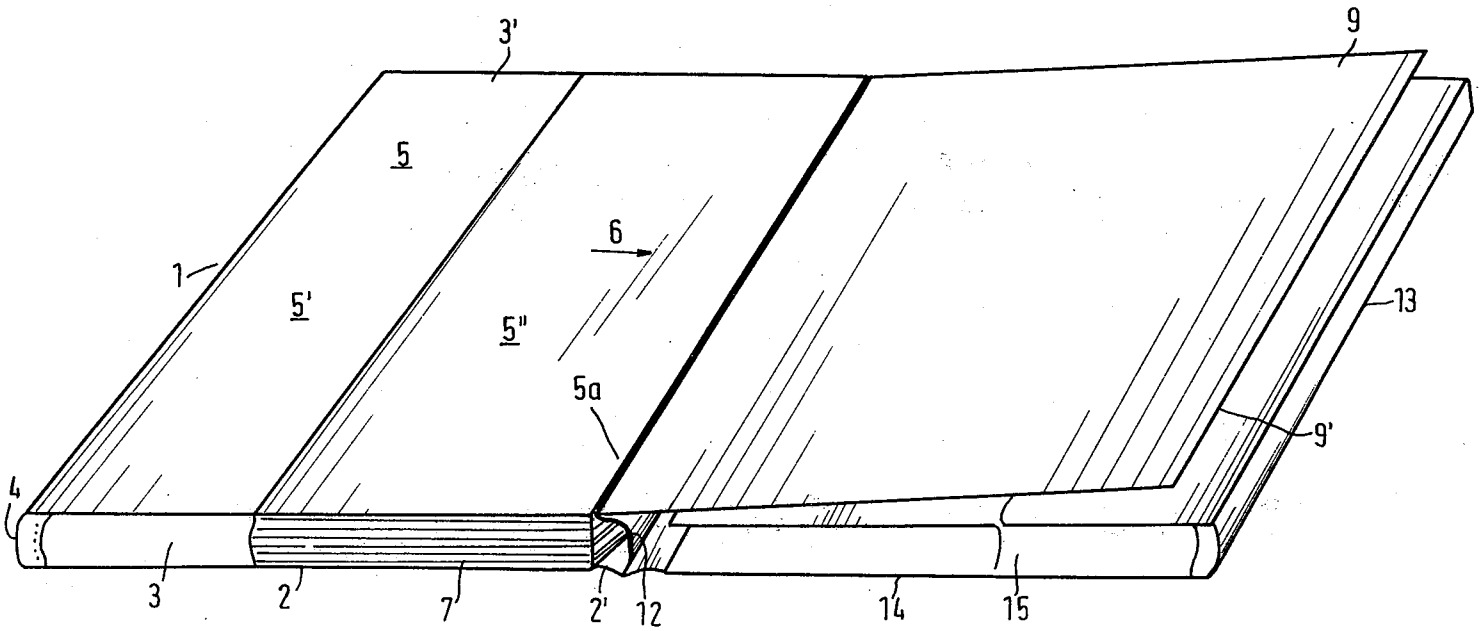
FIG. 2 is an illustration of the device of FIG. 1 wherein the receiving pocket has been loaded with a zig-zag folded stack of continuous business form sets.
Figure 3:
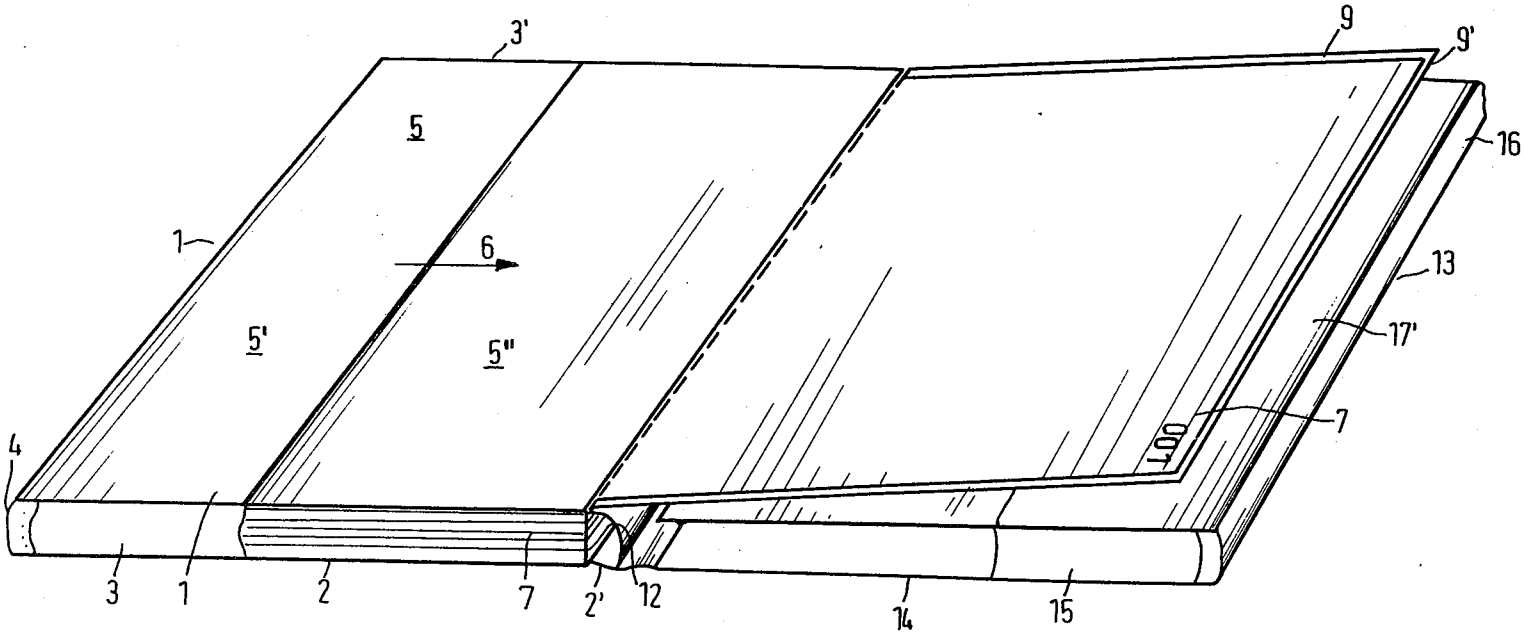
FIG. 3 shows the device of FIG. 2 wherein the first form set of the continuous form sets has been pulled from the stack and placed on the writing surface defined by the registration plate to receive a handwritten record.
Figure 4:
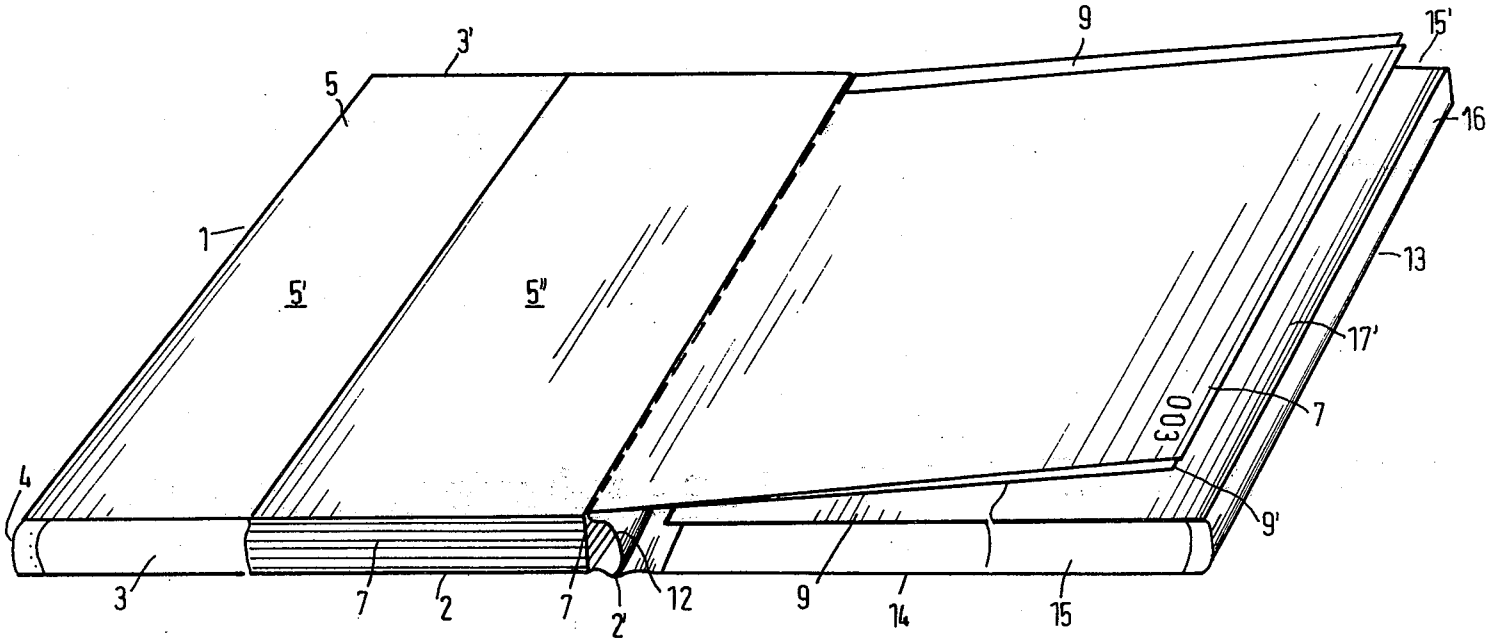
FIG. 4 shows the device of the invention wherein the continuous form sets have been pulled from the receiving pocket so that one form set, upon which a handwritten record has already been placed, has been folded about the registration plate along the transverse perforation and the next form set is on the writing surface of the registration plate.

The pocket 1 at least partially surrounds the zig-zag folded stack 7 of continuous business form sets so that this stack is held safely in its zig-zag folded condition as shown in FIG. 2. The pocket 1 is open in the direction in which the continuous form sets are pulled therefrom when it is desired to enter a handwritten record. This withdrawal opening is designated generally by reference numeral 8 in FIG. 1.

Figure 5:
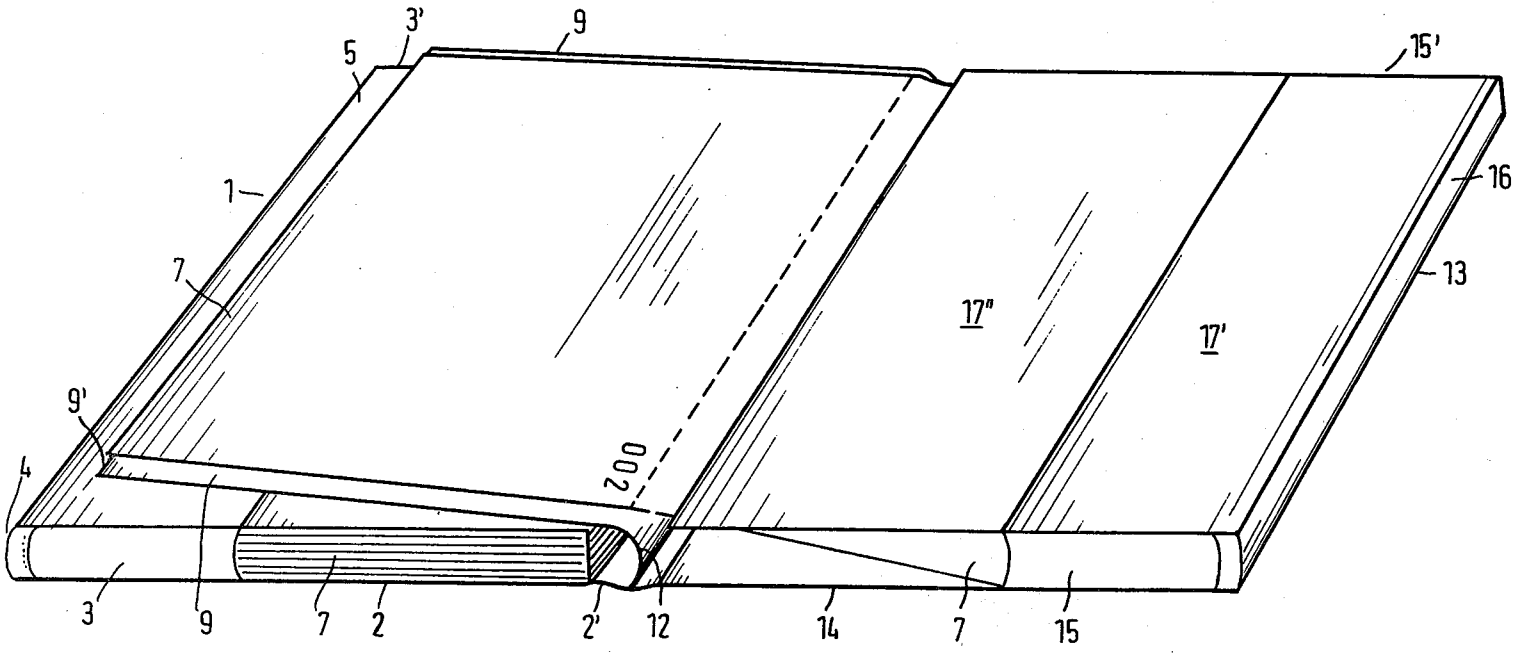
FIG. 5 shows the device of the invention wherein two business form sets of the continuous business form sets have been folded over the registration plate upon which it is desired to enter a handwritten record. A further form set is shown upon which a handwritten record has already been entered and which has been placed in the storage pocket.

A movable registration plate 9 is connected to the pocket 1 and is preferably made of material which is stiff and is yet suitable as a writing surface. In the region of its inner end, the registration plate is elastic to permit bending and is articulately connected with an extension 2' of the base plate 2 by means of an appended hinge link 12. By means of this appended hinge link 12, the registration plate 9 can be turned over to the left (FIG. 1) in the direction of arrow 10 and can be also advantageously turned over to the other side in the direction of arrow 11. The registration plate 9 can be brought into a position wherein it is parallel to the base plate 2 (FIG. 5). The registration plate 9 is advantageously configured to correspond to the format of an individual business form set of the continuous business form sets so that it has the same surface area as the individual form set or just a little larger.

When the continuous form sets are pulled from the pocket 1 to place an individual form set thereof in position on the writing surface of the registration plate 9 for entering a handwritten record thereon, it is essential that the outer edge 9' of the plate 9 lies exactly in the line defined by the transverse perforation between mutually adjacent ones of the form sets (see FIG. 5). Accordingly, it is most important that the registration plate 9 be mounted with respect to the pocket 1 to ensure that its outer edge 9' does indeed lie at the transverse perforation as described above. By means of this exact position of the plate 9 and especially its outer edge 9', the accurate registration required for obtaining precise record copies which are accurate with respect to the original of the business form sets is obtained when withdrawing the continuous form sets from the pocket 1. Of course, to achieve this accuracy, the continuous business form sets must be so laid over the plate 9 so that the transverse perforation between two mutually adjacent ones of the form sets lies on the edge 9'.

The same objective of establishing accurate registration of those form sets of the continuous form sets pulled from the stack 7 in direction 6 is achieved with the aid of the free edge **5*a* of the cover plate 5 because, for a corresponding condition of the zig-zag folded continuous form sets, this edge 5*a* determines registration accuracy by means of an exact placement of the transverse perforation thereon when the individual form set upon which a record is to be made is pulled from the stack and folded over this edge 5*a*. Because of this registration accuracy, the registration plate 9 must be so linked to the base plate 2** so that it is exactly plan parallel with respect thereto.

As described above, the device of the invention can comprise simply the receiving pocket 1 for the zig-zag folded continuous business form sets which it is intended to place handwritten records and a registration plate arranged with respect to receiving pocket 1 according to size and dimension. As noted, the registration plate also serves as a writing surface when writing a record by hand and is therefore made of a stiff material with an even surface.

According to a preferred and improved embodiment, the device of the invention can be configured so that the receiving pocket 1 and the registration plate 9 corresponding thereto are provided with a storage pocket 13. This storage pocket 13 is advantageously constructed so as to correspond to the receiving pocket 1. Accordingly, storage pocket 13 preferably includes side walls 15 and 15' flexible in elevation, a back wall 16 and a cover plate 17. This cover plate 17 can be constructed in the same way as cover plate 5. Namely, with a rear portion 17' securely connected to side walls 15 and 15' and a front portion 17'' pivotally connected to the back portion 17' to permit folding the same upwardly. The dimensions of the storage pocket 13 correspond to those of the receiving pocket 1 so that in this preferred embodiment, the device is mirrorsymmetrical to the registration plate 9 when the latter is turned up so as to be perpendicular to the base plates 2 and 14. In this connection, it is noted that the storage pocket 13 is likewise connected with the base plate 2 of the receiving pocket 1 by means of a hinge-like extension 18.

Those form sets of the continuous business form sets upon which handwritten records have been entered are stored in the storage pocket 2 most advantageously in a zig-zag folded stack so that the entire continuous form sets are maintained as a long continuous chain. With the continuous form sets in the zig-zag folded condition, the same is suitable for later feeding into an automatic recording machine wherein additional data can be machine-recorded on the form sets. Of course, if desired, the individual form sets upon which handwritten records have been entered can be separated at the respective transverse perforations and stored individually in the storage pocket 13.

The registration accuracy between the original record sheet and the copy record sheets therebeneath of each of the form sets making up the stack of continuous form sets is obtained in the device of the invention by maintaining the zig-zag folded condition of the continuous form sets in combination with the transverse perforations between mutually adjacent form sets of the continuous form sets and the position of the edge 9' of the registration plate 9 and the edge 5a of the pivotally mounted front portion 5'' of the cover plate 5; the position of edge 9' being precisely placed with respect to the transverse perforations.

It is advantageous to configure the registration plate 9 so that it is wider at one of the side edges so as to define an appendage useful for manually grasping the registration plate so that it can be conveniently folded over. In the simple embodiment of the invention without a storage pocket 13, the handwritten record can be entered on the continuous form sets also after placement of the registration plate 9 on the top side of the cover plate 5 if the continuous form set is folded over after being pulled out in the direction of the arrow 10. In this simple embodiment also, the registration plate 9 provides a writing surface for the continuous form sets pulled out of the pocket 1 when a handwritten record is to be entered thereon. The registration plate 9 can also serve as a cover plate for the receiving pocket 1. In this way, a very flat device is obtained. That portion of the continuous form sets upon which handwritten records are to be entered, and in the event that the embodiment has a storage pocket 13, also the remaining portion of the continuous form sets upon which handwritten records have already been placed, always have a flat format in the zig-zag folded condition.

The device of the invention is configured as a book and therefore is especially handy so that it can be conveniently carried in a briefcase. A major advantage of the device is that in the case of continuous form sets which are to be inscribed with handwritten records, the usual guide holes on the side margins are not required whereby either the useful space of the form set can be increased or a substantial savings in paper can be realized. Because of the optimal flat condition of the stack of the continuous business form sets, every upward movement and therefore every displacement of the individual record sheets with respect to each other is avoided thereby making unnecessary the guide holes associated with the devices of the prior art.

A further advantage is that the handwritten records can be inscribed in a very flat condition by means of a sure and comfortable hand movement by the writer. The individual form sets of the continuous form sets which have been inscribed with a handwritten record can, after such record is made, be stored in the storage pocket 13 in the same sequence to await further inscription; or, individual copies can be separated and handed to the customer while the individual form sets already inscribed can be stored or, such storage can be had in the zig-zag condition after separation of individual record copies.

The symmetrical configuration of the embodiment of the device with receiving and storage pockets makes it possible to provide handwritten records in the opposite sequence, that is, against the pull-out direction 6 so that handwritten records can be entered according to the desired numbering (ascending or descending).

The device of the invention is especially useful where it is desired to add handwritten record data to the form sets of the continuous business form sets wherein the latter have already been inscribed with automatic printing machinery, the continuous form sets being of the kind known in the prior art wherein registration apertures are provided. Adding such data to preprinted continuous business forms is often necessary directly at the conference with the customer. For example, such added record data could be dates or signatures.

The continuous form sets are preprinted by automatic printing machinery so that they have a sequence such as by number. Accordingly, for these records entered later by hand, it is necessary that the business form set is maintained in sequence with accurate registration.

The device according to the invention assures the registration accuracy of the form set notwithstanding handwritten entries. Because of this fact, the continuous form sets which have been preprinted by machine can be supplemented with a handwritten record entry simply and quickly at any time without having to separate the individual form sets from each other.

To ensure that the necessary registration accuracy is maintained irrespective of ambient temperature, it is desirable to manufacture the device of the invention from a material having a small coefficient of expansion so that dimensional changes of the device are substantially prevented.

In addition, the side walls 15 and 15' of the storage pocket 13 adapt the pocket to stacks of zig-zag folded continuous form sets by expansion in elevation and thereby securely hold these stacks.

We claim:

1. A device for obtaining accurate registration of handwritten impressions on continuous business form sets, the latter being separable into individual form sets by means of longitudinally spaced transverse perforations that also permit zig-zag folding of the form sets into a stack, the individual form sets having predetermined planar dimensions, the device comprising:

receiving means for receiving a zig-zag folded stack of the continuous business form sets, said receiving means being a receiving pocket at least partially surrounding the zig-zag folded stack, said pocket having an opening facing in the direction in which the continuous form sets are pulled therefrom;

said pocket including: a base plate, a back wall connected to the base plate, mutually adjacent side walls also connected to said base plate, and a cover plate parallel to said base plate, said cover plate being connected to said back wall and said side walls to conjointly define therewith the pocket space for receiving the zig-zag folded stack therein;

said cover plate including a rear portion extending over only a part of said base plate, said side walls having respective edges facing away from said back wall, said wall edges, said cover plate and said base plate conjointly defining said opening, said pocket also including a flap-like front portion pivotally connected to said rear portion at said opening so as to extend in the direction in which the continuous business form sets are pulled from said pocket; and registration means for registering and maintaining the form sheets of a given form set in a predetermined spaced relationship to each other, said registration means including: a registration plate defining a writing surface whereon the form set is placed to receive the handwritten entry, and connection means for movably connecting said plate to said pocket; and, said connecting means being an articulating hinge-like joint connecting said registration plate to said pocket so as to permit pivoted translation of said registration plate into and out of a position parallel to said base plate;

said registration plate being made of a stiff material and having substantially the same planar dimensions as an individual form set, said registration plate including an outer edge spaced away from said articulating hinge-like joint and said front portion too having an outer edge spaced away from the location whereat the same is connected to said rear portion, said front portion outer edge and said registration plate outer edge being parallel to each other.

2. The device of claims 1 comprising storage means for receiving the form sets after handwritten records have been entered thereon, said storage means being connected to said pocket and being disposed behind said registration plate when viewed in said direction in which the continuous form sets are pulled from said pocket.

3. The device of claim 2, said storage means being a storage pocket having a size and structure corresponding to said receiving pocket.

4. The device of claim 3 comprising additional articulating hinge-like connection means for connecting said storage pocket to said receiving pocket so as to cause said registration plate to be disposed between said pockets.

5. The device of claim 4 said registration plate defining a symmetry plane when turned up to define an angle of ninty degrees with respect to said base plate of said receiving pocket, said storage pocket being configured so to be the mirror-image of said receiving pocket with respect to said symmetry plane.

6. A portable, hand-held book-like device for obtaining accurate registration of handwritten impressions on continuous business form sets, the latter being separable into individual form sets by means of longitudinally spaced transverse perforations that also permit zig-zag folding of the form sets into a stack, the device comprising:

receiving means for receiving a zig-zag folded stack of the continuous business form sets; said receiving means including: a base plate defining one cover of the book-like device; and pocket means formed on the inside surface of said base plate for holding the stack of form sets; and registration means for coacting with at least one of the transverse perforations between two mutually adjacent ones of the form sets of the continuous business form sets; said registration means being a registration plate hinge connected to said base plate to define the other cover of said book-like device and be rotatably movable to lie atop said pocket means when the book-like device is in the closed position, said registration plate further defining a writing surface whereon a form set is placed to receive a handwritten entry;

said pocket means having an opening formed therein to permit pulling the continuous form sets therefrom to coact with said registration plate; and said registration plate having substantially the same planar dimensions as an individual business form set and including edge means at its outer edge disposed away from said hinge for coacting with said one perforation for registering and maintaining the form sheets of a given form set in a predetermined spaced relationship with each other when a form set is pulled from said pocket means and the handwritten entry is made thereon.

7. The book-like device of claim 6 comprising: storage means for receiving the form sets of the continuous form sets upon which handwritten entrys have been made.

8. The book-like device of claim 7, said storage means being a storage pocket hinge-connected to said receiving pocket so as to cause said registration plate to be disposed therebetween whereby said device can be opened and closed in book-like fashion.

9. A portable, hand-held book-like device for obtaining accurate registration of handwritten impressions on continuous business form sets, the latter being separable into individual form sets by means of longitudinally spaced transverse perforations that also permit zig-zag folding of the form sets into a stack, the device comprising:

receiving means for receiving a zig-zag folded stack of the continuous business form sets; said receiving means including: a base plate defining one cover of the book-like device; and pocket means formed on the inside surface of said base plate for holding the stack of form sets; and registration means for coacting with at least one of the transverse perforations between two mutually adjacent ones of the form sets of the continuous business form sets; said registration means being a registration plate hinge connected to said base plate to define the other cover of said book-like device and be rotatably movable to lie atop said pocket means when the book-like device is in the closed position;

said pocket means including pocket edge means for coacting with a transverse perforation of the continuous business form sets when the latter are pulled from said pocket means; said registration plate having substantially the same planar dimensions as an individual business form set and including edge means at its outer edge disposed away from said hinge for coacting with another one of the transverse perforations of the continuous business form sets; said registration plate being connected to said base plate so as to cause said plate edge means to be parallel to said pocket edge means; said pocket edge means being located with respect to said registration plate so as to cause said pocket edge means and said plate edge means to coact with two mutually adjacent ones of said transverse perforations to maintain the form sheets of a given form set in a predetermined spaced relationship when entering a handwritten record.

10. The book-like device of claim 9, said registration plate defining a writing surface whereon the form set is placed when entering the handwritten record thereon.

11. The book-like device of claim 9 comprising: storage means for receiving the form sets of the continuous form sets upon which handwritten entrys have been made.

12. The book-like device of claim 11, said storage means being a storage pocket hinge-connected to said receiving pocket so as to cause said registration plate to be disposed therebetween whereby said device can be opened and closed in a book-like fashion.

* * * * *